US008177144B2

(12) United States Patent
Rossner et al.

(10) Patent No.: US 8,177,144 B2
(45) Date of Patent: May 15, 2012

(54) CONTAINER HOLDER IN A FLUID DELIVERY SYSTEM

(75) Inventors: Ross David Rossner, St. Michael, MN (US); Thomas C. Gessner, Plymouth, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 159 days.

(21) Appl. No.: 12/399,116

(22) Filed: Mar. 6, 2009

(65) Prior Publication Data

US 2010/0224698 A1 Sep. 9, 2010

(51) Int. Cl.
*B05B 9/04* (2006.01)
*F04B 53/00* (2006.01)

(52) U.S. Cl. ..... 239/332; 239/329; 239/DIG. 14; 417/234

(58) Field of Classification Search ..... 239/146, 239/302, 329, 331–333, 376, DIG. 14; 417/234, 417/572; 401/146
See application file for complete search history.

(56) References Cited

U.S. PATENT DOCUMENTS

| | | | | |
|---|---|---|---|---|
| 4,003,504 | A | 1/1977 | Johnson et al. | |
| 4,639,156 | A * | 1/1987 | Stern et al. | 401/146 |
| 5,217,238 | A | 6/1993 | Cyphers et al. | |
| 5,286,045 | A | 2/1994 | Cyphers et al. | |
| 5,441,297 | A | 8/1995 | Krohn et al. | |
| 7,240,909 | B2 | 7/2007 | Robens | |
| D580,518 | S | 11/2008 | Johnson et al. | |
| 7,458,601 | B2 | 12/2008 | Miller et al. | |
| D611,867 | S | 3/2010 | Peterson et al. | |
| 2004/0007632 | A1 | 1/2004 | Williams et al. | |
| 2008/0272150 | A1 | 11/2008 | Hahn et al. | 222/145.1 |

FOREIGN PATENT DOCUMENTS

WO 0214082 A1 2/2002

OTHER PUBLICATIONS

International Search Report and Written Opinion of counterpart application No. PCT/US2010/026178, filed on Mar. 4, 2010.

* cited by examiner

*Primary Examiner* — Darren W Gorman
(74) *Attorney, Agent, or Firm* — Westman, Champlin & Kelly, P.A.

(57) ABSTRACT

A container holder in a fluid delivery system is provided. In one example, an airless fluid delivery system is disclosed and includes a housing and a handle coupled to the housing. A first end of the handle is attached to the housing and a second end of the handle includes an attachment feature configured to receive and suspend a fluid container from the handle. In one example, a frame of the fluid delivery system includes a recess configured to receive the container. Further, in one example the handle extends transversely from the fluid delivery system and includes a empty container balance point and a full container balance point along a length of the handle.

3 Claims, 6 Drawing Sheets

CONTAINER HOLDER IN A FLUID DELIVERY SYSTEM

BACKGROUND

The present disclosure relates to a fluid delivery system, and more specifically, but not by limitation, to a portable airless paint spraying system having a handle with a feature for holding a fluid container.

One example of a fluid delivery system comprises a spray-coating system including a device configured to spray a coating (e.g., paint, ink, varnish, texture, etc.) through the air onto a surface. Such spray-coating systems often include a fluid source and, depending on the particular configuration or type of system, a motor for providing pressurized fluid to an output nozzle or tip that directs the fluid in a desired spray pattern. For example, some common types of paint spraying systems employ compressed gas, usually air compressed by an air compressor, to atomize and direct paint particles onto a surface. Other common types of paint spraying systems include airless systems that employ a pumping unit for pumping paint from a paint source, such as a paint can. Pressurized paint is pumped from the source through a hose, for example, to a spray gun having a tip with a particular nozzle shape for directing the paint in a desired pattern.

Many painting applications require user mobility. Some examples include, but are not limited to, painting an exterior of a building, painting interior walls and ceilings of a building, staining a deck or fence, to name a few. Further, such painting applications require that a paint source (e.g., a paint can) is carried with the spraying system by a user as the user moves during the paint application process.

The discussion above is merely provided for general background information and is not intended to be used as an aid in determining the scope of the claimed subject matter.

SUMMARY

The present disclosure provides a container holder in a fluid delivery system. In one exemplary embodiment, an airless fluid delivery system is disclosed and includes a housing and a handle coupled to the housing. A first end of the handle is attached to the housing and a second end of the handle includes an attachment feature configured to receive and at least partially support a fluid container from the handle.

In one exemplary embodiment, a portable device is disclosed and includes a fluid delivery system configured to deliver a fluid from a container. The portable device also includes a handle extending from the fluid delivery system and configured to support the container. The handle has an empty container balance point and a full container balance point along a length of the handle.

In one exemplary embodiment, a method of supporting a fluid container in a fluid delivery system is disclosed. The method includes attaching a bail of the fluid container to a handle of a fluid delivery system. The method also includes supporting a first portion of the container in a recess formed on a frame based on the fluid delivery system and supporting a second portion of the container with a lateral support structure of a fluid delivery system. The bail of the fluid container is positioned at an angle with respect to a vertical plane.

These and various other features and advantages will be apparent from a reading of the following Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

Figure 1:
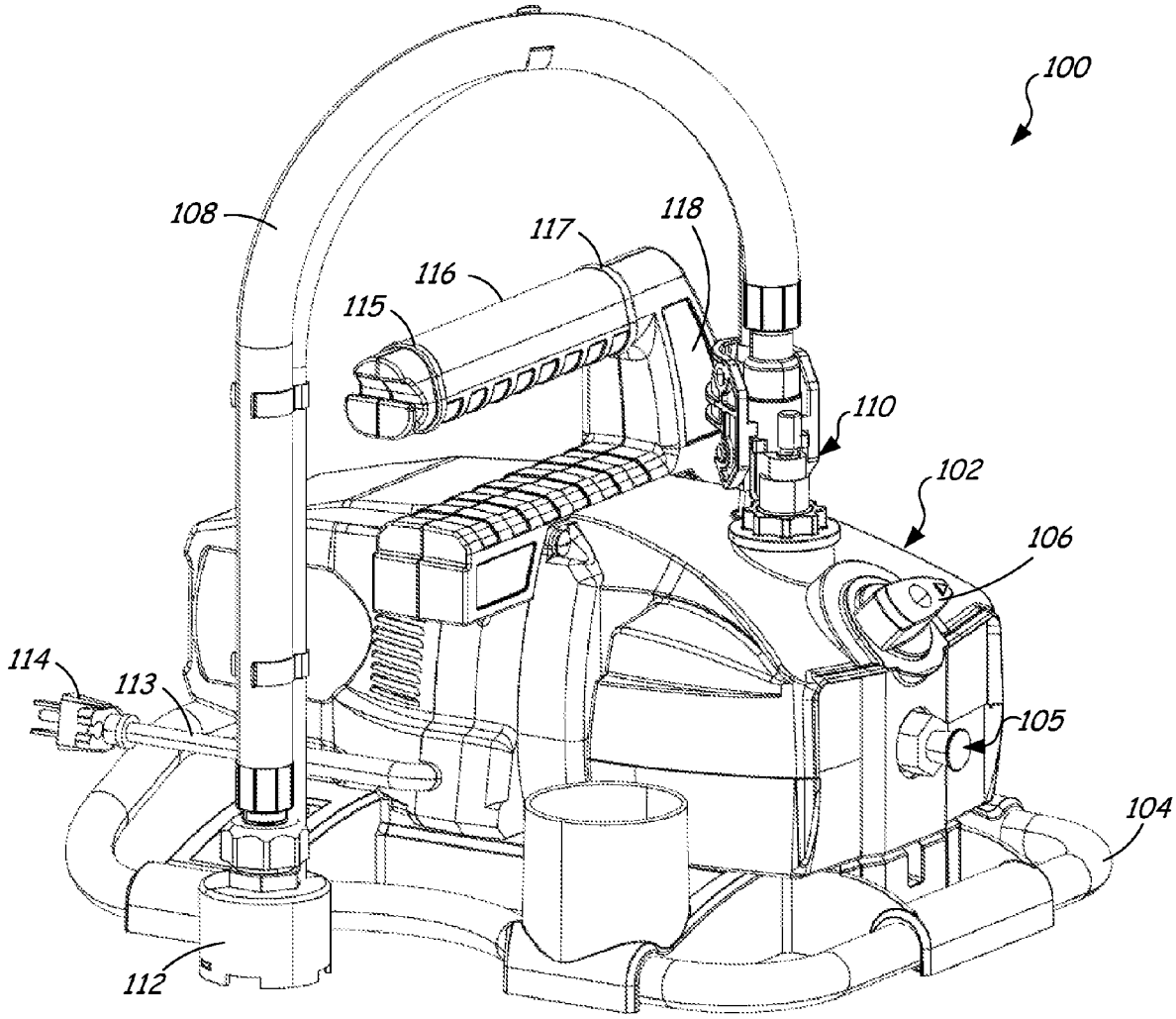
FIG. 1 is a perspective view of one embodiment of a fluid delivery system including a holder for a fluid container.

FIG. 1 is a perspective view of a fluid delivery system 100. As illustrated, system 100 comprises an airless fluid delivery system having a housing 102 including a pumping unit for pumping fluid (e.g., paint, stain, ink, varnish, etc.) from a fluid container (not shown in FIG. 1). The housing 102 is supported by a frame 104 that extends along at least a portion of a periphery of the housing 102 and is configured to support the housing 102 on a surface (e.g., floor, table, etc.). The pumping unit within housing 102 comprises a motor that pumps the fluid from the container through at least one conduit 108. Conduit 108 has an end 112 that is placed in fluid in the container. Conduit 108 is attached to housing 102 by a coupling unit 110 and provides a fluid path from the container. In one embodiment, coupling unit 110 removably couples conduit(s) 108 to housing 102.

While system 100 is illustrated as comprising an airless fluid delivery system, it is noted that in other embodiments system 100 can comprise other types of fluid delivery systems such as, but not limited to, compressed-air systems, air-assisted systems, electrostatic systems, high volume low pressure (HVLP) systems, low volume low pressure (LVLP) systems, to name a few.

Fluid delivery system 100 also includes an output port 105 through which pressurized fluid is discharged by the pumping unit. A conduit (not shown in FIG. 1), such as a tube, can be connected to housing 102 at output port 105 for supplying the pressurized fluid to a spray gun, for example.

Airless fluid delivery system 100 includes an electrical plug 114 and cord 113 for supplying power to the motor of the pumping unit in housing 102. Fluid delivery system 100 includes a power switch (i.e., an on/off switch) (not shown in FIG. 1). System 100 also includes a pressure adjustment mechanism 106 (illustrated as a rotatable dial) that controls operation of the pumping unit for providing desired pressures and fluid flows through port 105.

In the embodiment of FIG. 1, system 100 comprises a portable fluid delivery system and includes a handle 116 configured to enable system 100 to be carried by a user. As illustrated, handle 116 extends from and is transverse to housing 102. In one embodiment, handle 116 is substantially horizontal. Handle 116 has a first end 115 and a second end 117 attached to housing 102 at a joint 118. Joint 118 is designed with sufficient strength characteristics (in the form of material selection, geometry, dimensions, etc.) to support the weight of system 100 when a user carries system 100 by handle 116.

Figure 2:
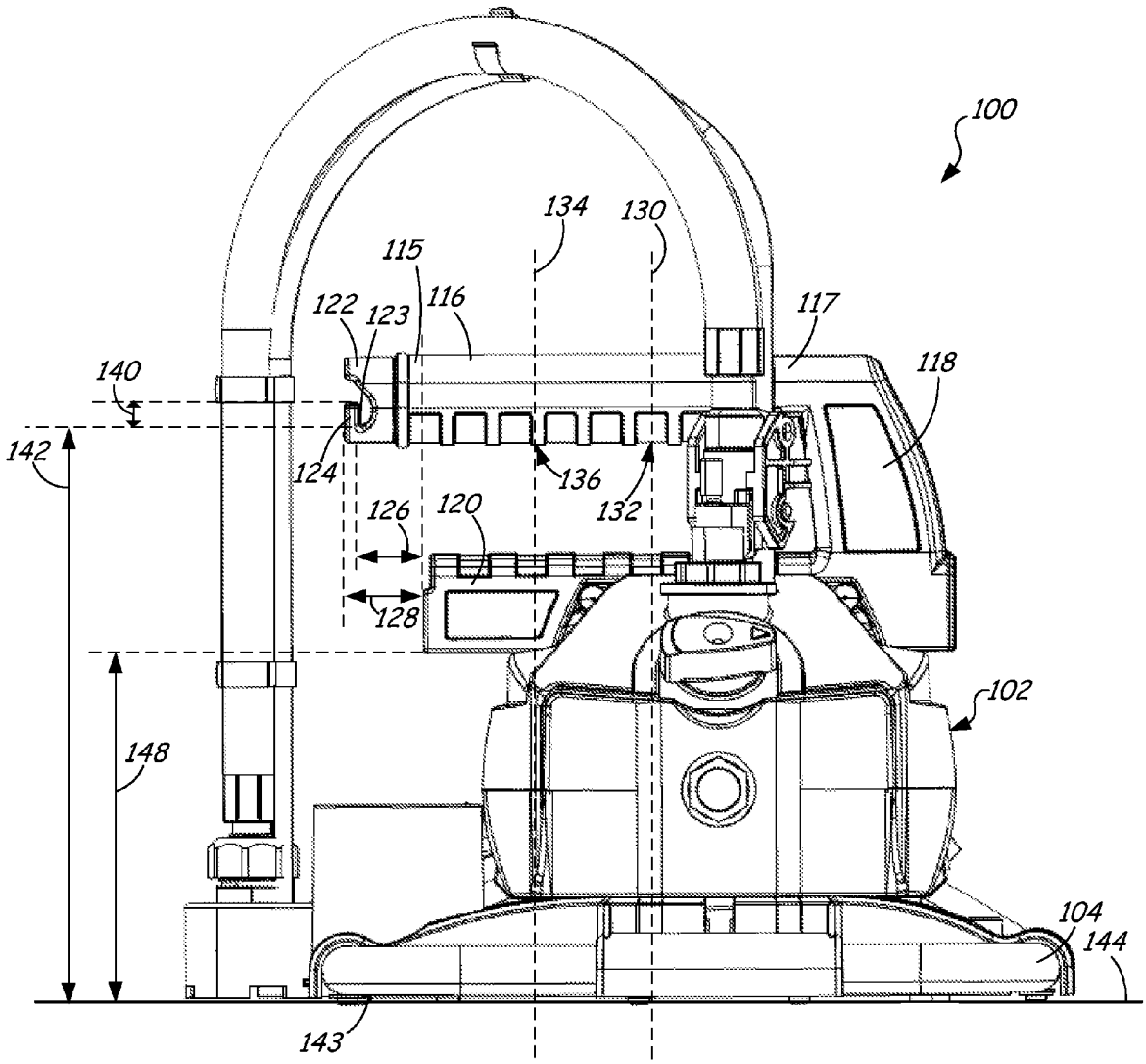
FIG. 2 is a side view of the fluid delivery system of FIG. 1.
Figure 3A:
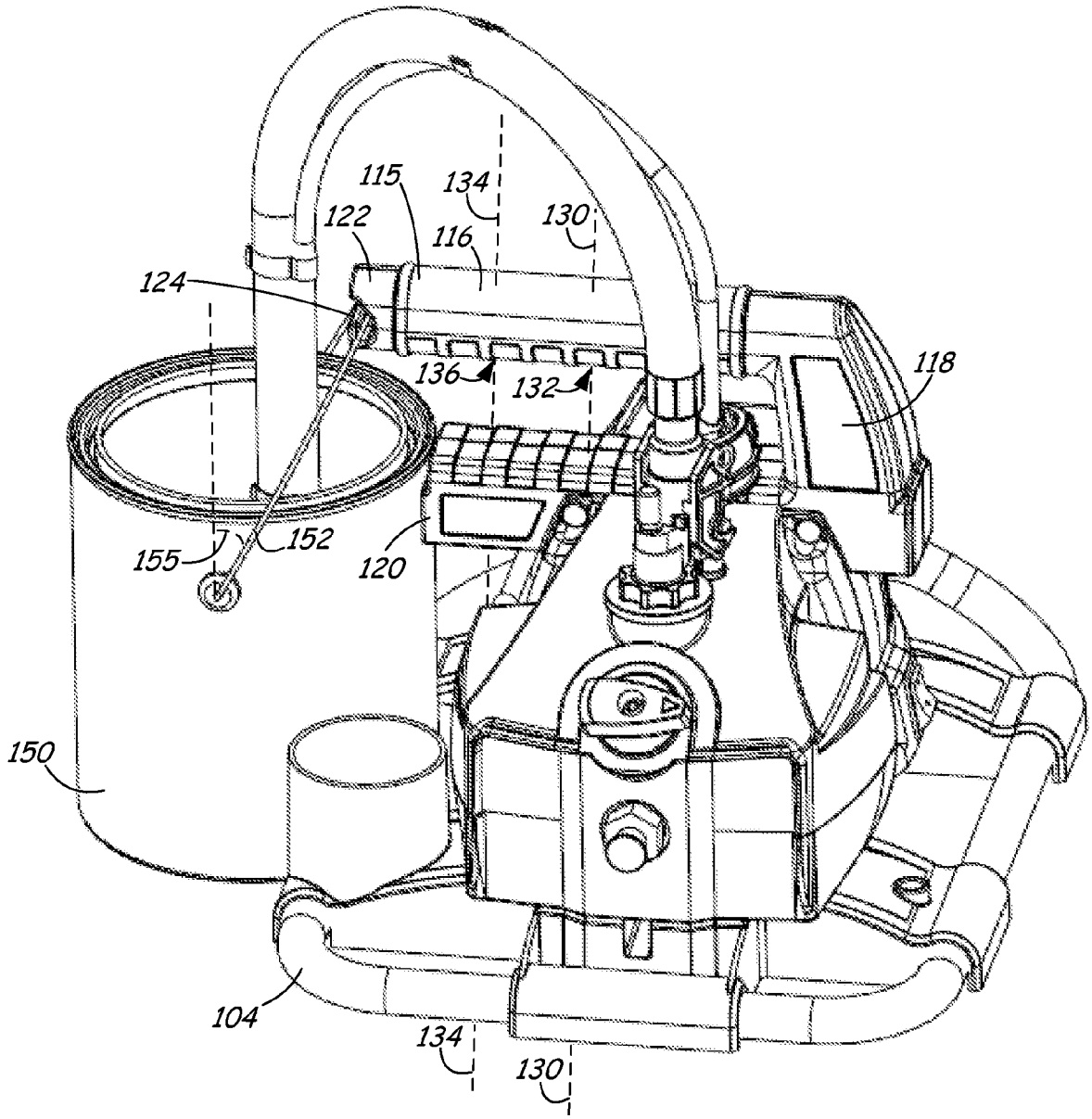
FIG. 3A is a perspective view of the fluid delivery system of FIG. 1 illustrating a fluid container attached to a handle.
Figure 3B:
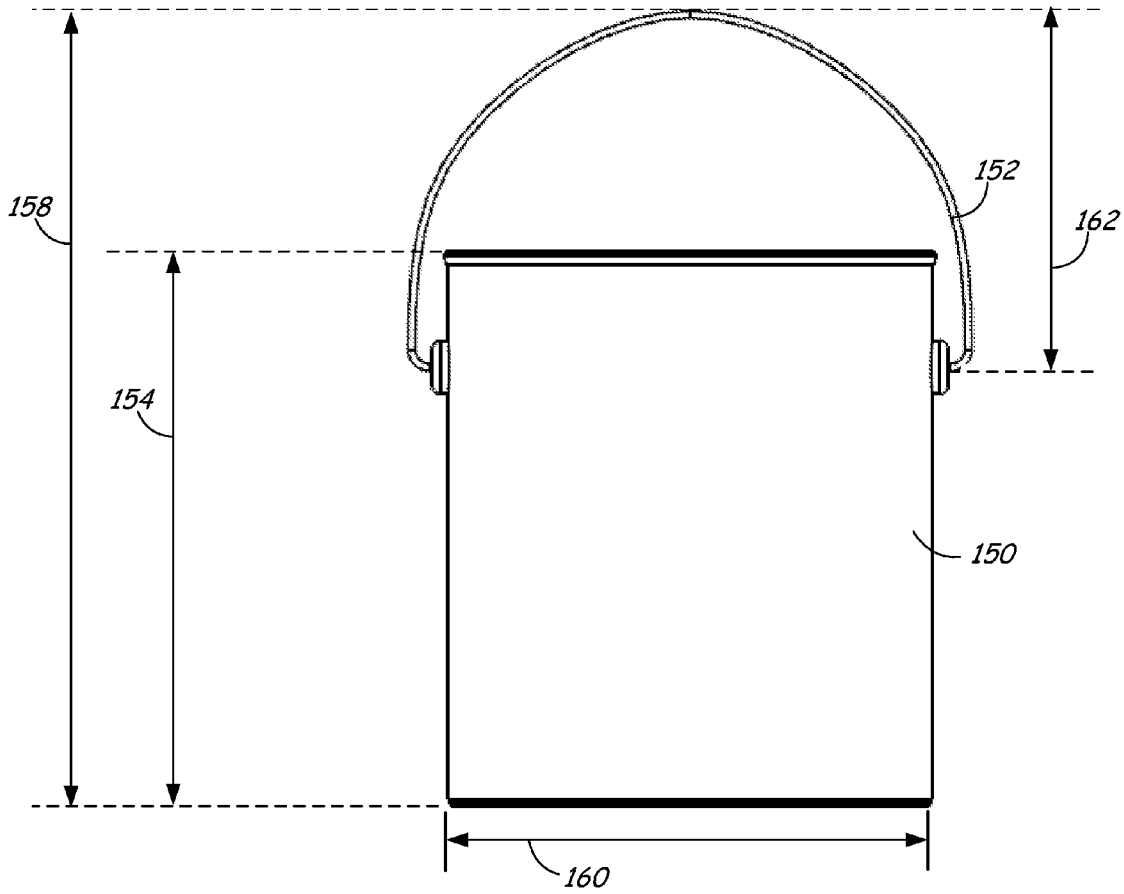
FIG. 3B is a side view of one embodiment of the fluid container illustrated in FIG. 3A.

Fluid delivery system 100 also includes at least one attachment feature for supporting a fluid container. FIG. 2 is a side view of system 100 and illustrates handle 116 having an attachment feature 122 at end 115. FIG. 3A is a perspective view of system 100 illustrating an exemplary fluid container 150 supported by attachment feature 122. FIG. 3B is a side view of the exemplary fluid container 150.

As illustrated in FIG. 3A, attachment mechanism 122 is configured to receive a bail 152 of container 150. Container 150 is illustratively a bucket or pail having a cylindrical shape. However, in other embodiments container 150 and bail 152 can have other shapes and configurations. Attachment mechanism 122 secures the bail 152 of container 150 such that when a user lifts system 100 using handle 116 container 150 is also lifted and suspended from end 115 of handle 116. In the illustrated embodiment, attachment mechanism 122 includes a hook 124 for securing bail 152. Bail 152 is supported by a recessed surface 123 formed by hook 124 (see FIG. 2) of attachment mechanism 122. A height 140 of hook 124 is selected such that the bail 152 of the container 150 remains secured within attachment mechanism 122 during movement (e.g., lifting, placement, etc.) of system 100, for example on a surface 144 such as a floor. In one embodiment, the height 140 of hook 124 is between approximately 0.25 and 0.75 inches. In one particular embodiment, height 140 is approximately 0.425 inches. However, it is noted that in other embodiments attachment mechanism 122 can include any other suitable sizes and configurations. For example, hook 124 and recess 123 can be sized based on the particular dimensions of bail 152. Moreover, in other embodiments attachment mechanism 122 can include other types of fasteners such as, but not limited to, pins, loops, clamps, to name a few.

In one embodiment, attachment mechanism 122 is removably attached to handle 116. In this manner, attachment mechanism 122 can be removed and/or interchanged with other attachment mechanisms having different sizes and/or shapes.

Further, in accordance with one embodiment the container 150 is in contact with and at least partially supported by one or more portions of housing 102 and/or frame 104. For example, in the illustrated embodiment, fluid delivery system 100 includes a lateral container support 120 that extends from housing 102 and is configured to engage a first portion of container 150. Support 120 limits or prevents lateral movement of container 150 in one or more directions. Further, as discussed below in the context of FIGS. 4 and 5, frame 104 of system 100 is also configured to engage and at least partially support a second portion of container 150. In one embodiment, support 120 and frame 140 are configured to orient container in a substantially upright or vertical position. The particular configuration of support 120 and frame 104 can be designed based on the particular dimensions of container 150. One example of container 150 is illustrated in FIG. 3B.

In the embodiment of FIG. 3B, container 150 is configured to hold a gallon of fluid (e.g., paint, varnish, stain, etc.). However, other sizes of container 150 are within the scope of the concepts described herein. In the example of FIG. 3B, container 150 has an outside diameter 160 of approximately 6.69 inches and a height 154 of approximately 7.75 inches. Further, container 150 has an overall height 158 (including bail 152) of approximately 11.06 inches and a length 162 from a tip of bail 152 to an axis at the connection point of bail 152 is approximately 4.9 inches. Again, it is noted that FIG. 3B is one example of container 150 and is not intended to limit the scope of the concepts described herein. For example, in other embodiments container 150 can have a non-cylindrical shape. Further, in another example diameter 160 is between approximately 6 and 7 inches and height 154 is between approximately 7.25 and 8.25 inches. Further, in one embodiment height 158 is between approximately 10 and 12 inches and length 162 is between approximately 4 and 6 inches.

With reference to FIGS. 2 and 3A, the attachment and container support components of system 100 can be configured depending on the particular dimensions of container 150. For instance, depending on the particular dimensions of container 150 the container support 120 and frame 104 are configured such that when container 150 is suspended from handle 116 the container 150 is in a substantially upright or vertical position and bail 152 is at an angle 155 with respect to vertical. In one example, angle 155 is approximately 45 degrees with respect to vertical. However, it is noted that angle 155 can be greater than or less then 45 degrees. The angle 155 of bail 152 causes at least a portion of the force resulting from the weight of the container 150 to be in a direction toward support 120 and frame 104.

Further, the height 142 from surface 123 of attachment mechanism 122 that supports bail 152 to bottom surface 143 of frame 104 is configured such that container 150 rests on surface 144 when frame 104 is placed on surface 144. In this manner, the weight of container 150 does not exert, or exerts a minimal amount of, downward force upon handle 116 when system 100 is placed on surface 144. Also, the height 142 is configured such that the bail 152 of container 150 remains within the attachment mechanism 122 when container 150 and frame 104 are placed on surface 144.

In one embodiment, to accommodate the dimensions of exemplary container 150 illustrated in FIG. 3B, the height 142 between surface 123 of attachment feature 122 and the bottom surface 143 is approximately 10.13 inches. Further, a distance 126 between support 120 and a vertical plane defined by hook 124 is approximately 1.12 inches. A distance 128 between support 120 and a vertical plane defined by the outer edge of hook 124 is approximately 1.35 inches and support 120 is positioned a height 148 of approximately 6.15 inches from surface 143. Again, it is noted that these dimensions are exemplary and are not intended to limit the scope of the concepts described herein.

When a user lifts fluid delivery system 100 using handle 116, the weight of housing 102 (including internal components such as the pumping unit) and frame 104 is supported by joint 118 that connects end 117 of handle 116 to housing 102. In accordance with the illustrated embodiment, the weight of the container 150 and any fluid contained therein is supported on end 115 of handle 116 that is opposite end 117. In this manner, when a user lifts system 100 using handle 116 the weight of container 150 on attachment mechanism 122 is not supported by joint 118.

Fluid delivery system 100 has an "empty container" center of mass when container 150 is empty, or alternatively a "no container" center of mass when container 150 is not attached to handle 116. Further, when container 150 is full of fluid the weight of container 150 upon attachment mechanism 122 offsets a portion of the weight of system 100. As such, a "full container" center of mass of system 100 is different than the "empty container" or "no container" center of mass of system 100. Lines 130 and 134 illustrate axes through the "empty container" center of mass and "full container" center of mass, respectively, in the exemplary embodiment of FIG. 2. In accordance with one embodiment, as a function of the center of masses of the "full container" and "empty container" configurations, an "empty container" balance point 132 and "full container" balance point 136 exist along a length of handle 116. The "empty container" balance point 132 represents a position along the handle 116 where system 100 is substantially balanced when a user lifts system 100 (with an empty container). Further, the "full container" balance point 136 represents a position along the handle 116 where system 100 is substantially balanced when a user lifts system 100 (with a full container). While FIGS. 2, 3A, and 4 illustrate points 132 and 136 at particular positions along handle 116, it is noted that the balance points 132 and 136 can exist along the handle 116 at different positions depending on the particular weight characteristics of system 100, including container 150 and any fluid contained therein.

Figure 4:
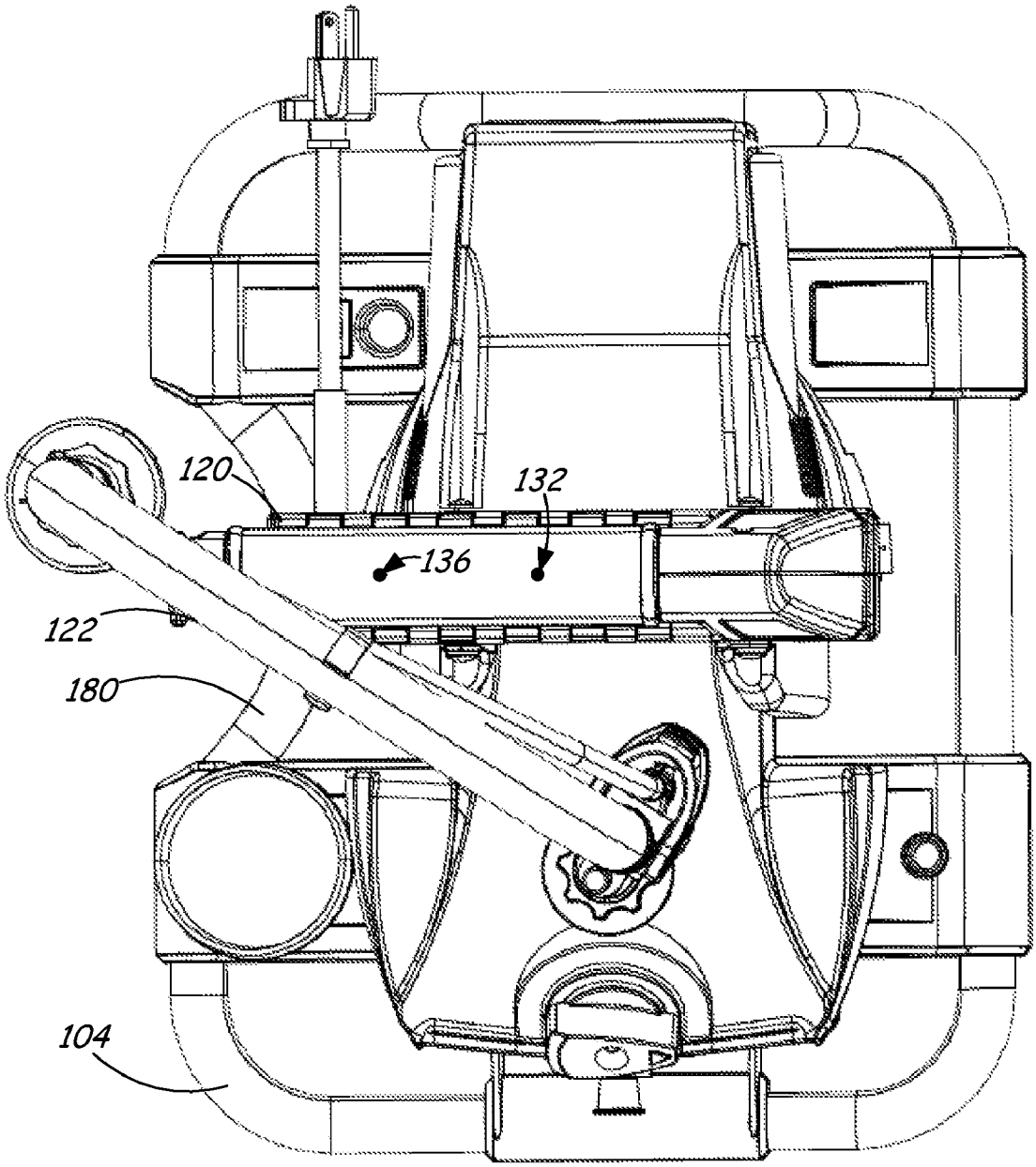
FIG. 4 is a top plan view of the fluid delivery system of FIG. 1.
Figure 5:
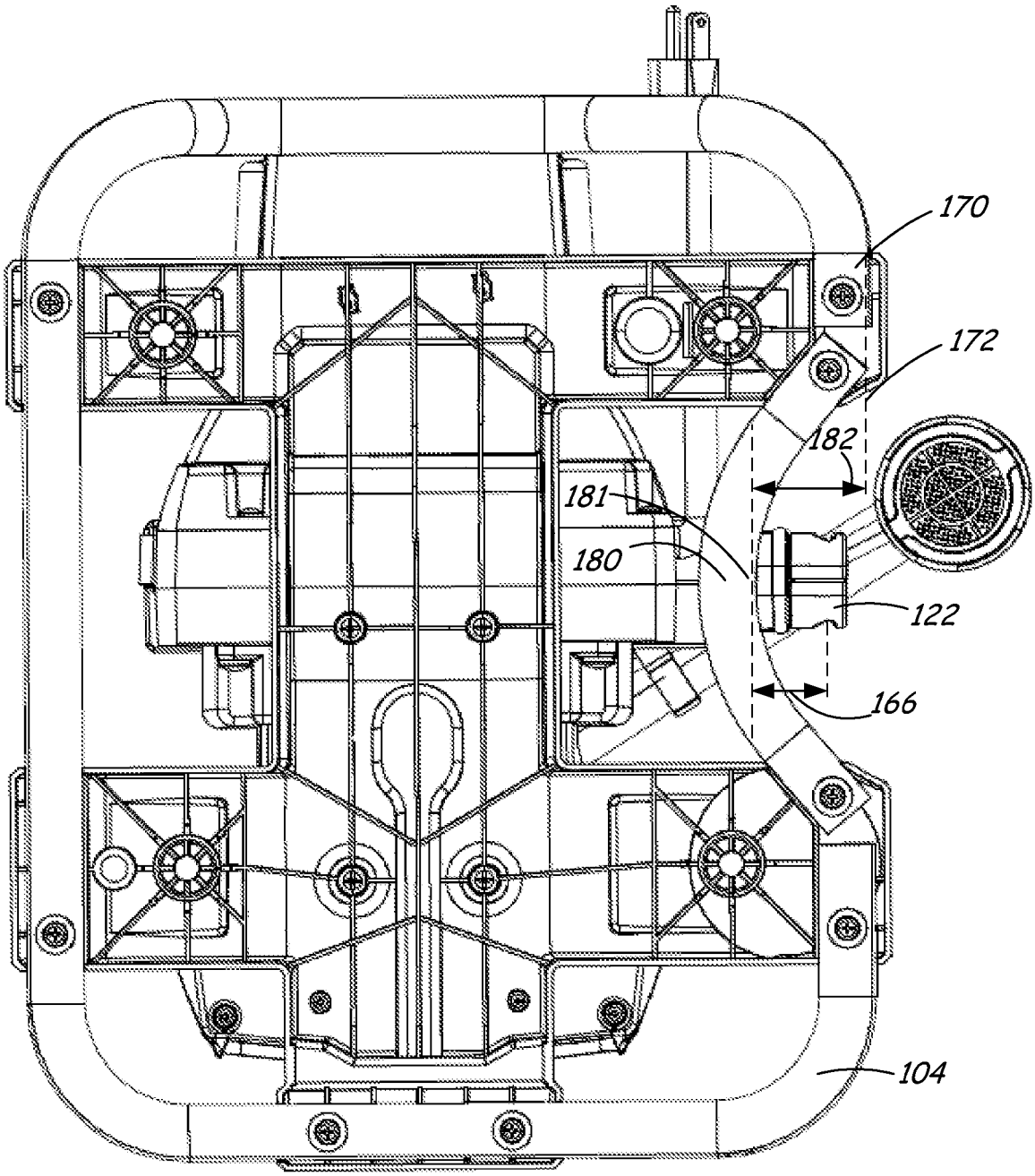
FIG. 5 is a bottom plan view of the fluid delivery system of FIG. 1.

As illustrated in FIGS. 4 and 5, frame 104 includes a first portion 170 defining an outer periphery 172 of frame 104. Frame 104 also includes a recessed portion 180 having a recess that is displaced as indicated by double arrow 182) from the outer periphery 172 of frame 104. Recess 180 is configured to receive and support a portion of container 150. The size and shape of recess 180 can be configured based on the particular shape and size of container 150. For example, in the embodiment of FIGS. 4 and 5 recessed portion 180 has an arcuate shape that is similar to the cylindrical shape of container 150. However, in other embodiments the shape of recessed portion 180 is not arcuate. For example, surfaces of recess 180 can form angles for receiving non-cylindrical containers. For instance, a container can be polygonal, square-shaped, triangular, etc.

In the embodiment illustrated in FIGS. 4 and 5, a distance 166 between the apex 181 of recess 180 and a vertical plane defined by hook 124 is substantially the same as the distance 126 between support 120 and the vertical plane defined by hook 124 (shown in FIG. 2). For example, in one embodiment distances 126 and 166 are approximately 1.12 inches. In this manner, recess 180 and support 120 of system 100 support container 150 in a substantially upright or vertical position.

It is to be understood that even though numerous characteristics and advantages of various embodiments of the invention have been set forth in the foregoing description, together with details of the structure and function of various embodiments of the disclosure, this disclosure is illustrative only, and changes may be made in detail, especially in matters of structure and arrangement of parts within the principles of the present disclosure to the full extent indicated by the broad general meaning of the terms in which the appended claims are expressed. For example, the particular elements may vary depending on the particular application for the system or method while maintaining substantially the same functionality without departing from the scope and spirit of the present disclosure and/or the appended claims.

What is claimed is:

1. A portable fluid sprayer for spraying fluid supplied from a fluid container, the portable fluid sprayer comprising:

a sprayer housing having a fluid pump;

a sprayer handle for carrying the portable fluid sprayer;

a hook configured to receive a handle of the fluid container; and a base for supporting the portable fluid sprayer on a support surface, the base having a bottom surface configured to contact the support surface and a bottom surface plane defined by the bottom surface, the base having a recessed portion comprising a concave surface and forming an opening at and extending from the bottom surface plane for receiving at least a portion of the fluid container.

2. The portable fluid sprayer of claim 1, wherein the hook is spaced approximately 9.75 to 10.5 inches from the bottom surface plane of the base.

3. The portable fluid sprayer of claim 1, wherein the recessed portion has a laterally facing surface that is adjacent the bottom surface plane and is configured to contact a side surface of the fluid container.

* * * * *